US005396948A

United States Patent [19]

Poussin

[11] Patent Number: 5,396,948

[45] Date of Patent: Mar. 14, 1995

[54] HEAT EXCHANGER, IN WHICH THE SUPPLY OF SECONDARY FLUID TAKES PLACE IN THE UPPER PART BY MEANS OF AN OVERFLOW

[75] Inventor: Christophe Poussin, Courbevoie, France

[73] Assignee: Framatome, Courbevoie, France

[21] Appl. No.: 179,657

[22] Filed: Jan. 11, 1994

[30] Foreign Application Priority Data

Jan. 11, 1993 [FR] France ..... 93 00170

[51] Int. Cl.[6] ..... F28D 7/00

[52] U.S. Cl. ..... 165/159; 122/32

[58] Field of Search ..... 165/159, 160; 122/32, 122/33

[56] References Cited

U.S. PATENT DOCUMENTS

| | | | |
|---|---|---|---|
| 3,683,866 | 8/1972 | Zmola | 122/32 |
| 3,906,905 | 9/1975 | Andrieu et al. | 122/32 |
| 3,913,531 | 10/1975 | von Hollen | 122/32 |
| 3,923,007 | 12/1975 | Schroder | 122/32 |
| 3,938,473 | 2/1976 | Mayer et al. | 122/32 |
| 4,148,281 | 4/1979 | Stoll et al. | 122/32 |
| 4,357,908 | 11/1982 | Yazidjian | 122/32 |
| 4,429,739 | 2/1984 | Gentry et al. | 165/159 |
| 4,462,340 | 7/1984 | Mayer | 122/34 |

FOREIGN PATENT DOCUMENTS

| | | |
|---|---|---|
| 045034 | 2/1982 | European Pat. Off. . |
| 2210273 | 7/1974 | France . |

*Primary Examiner*—John Rivell
*Assistant Examiner*—L. R. Leo
*Attorney, Agent, or Firm*—Pollock, Vande Sande & Priddy

[57] ABSTRACT

In a heat exchanger such as a steam generator equipping a nuclear power station the secondary fluid is injected into the upper part of an annular space (30) formed between an outer envelope (10) and a bundle or core envelope (26) having a common vertical axis. Injection takes place by means of a supply pipe (44), which issues into an overflow or weir (62). The latter has an upper horizontal edge (64) from which the secondary fluid is discharged onto a deflecting wall (54). The secondary fluid flows along this wall towards the bottom of the annular space (30). A device (60) for trapping migrating bodies can also be placed in the overflow (62) or between the latter and the deflecting wall (54).

13 Claims, 4 Drawing Sheets

FIG. 2
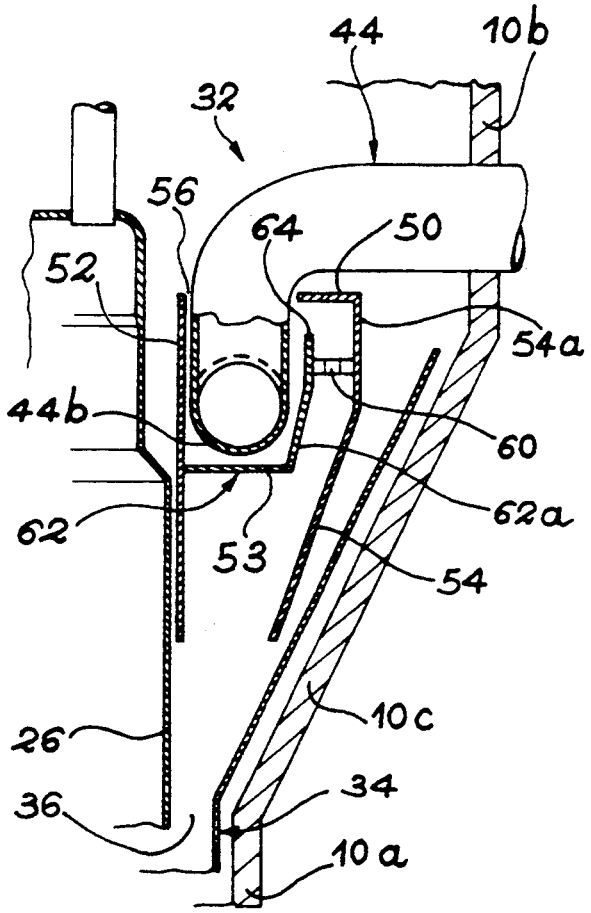
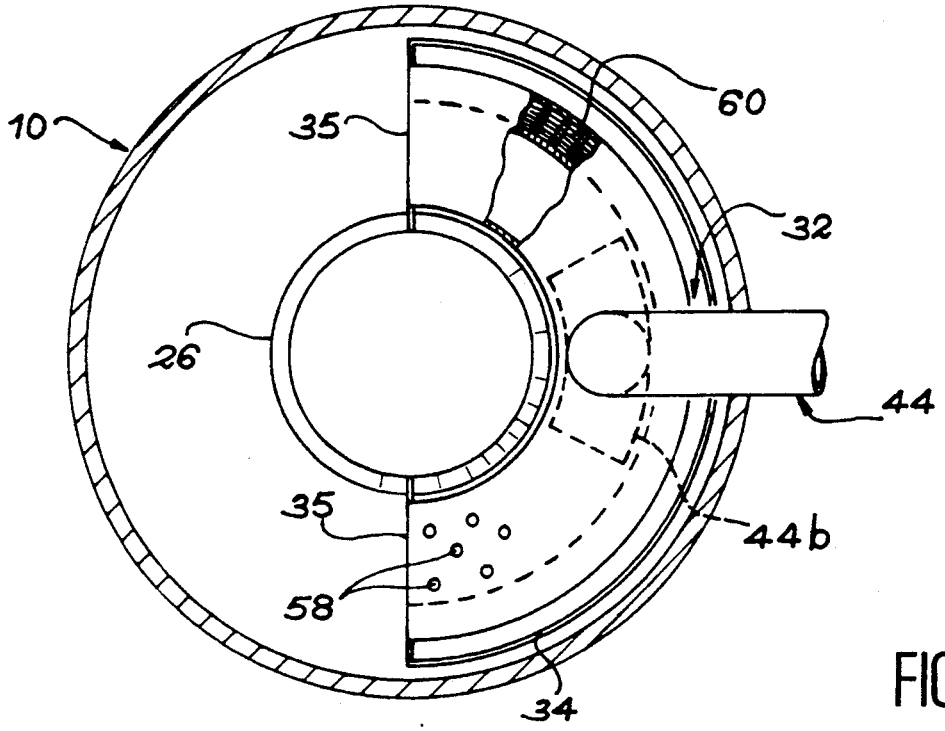
FIG. 3

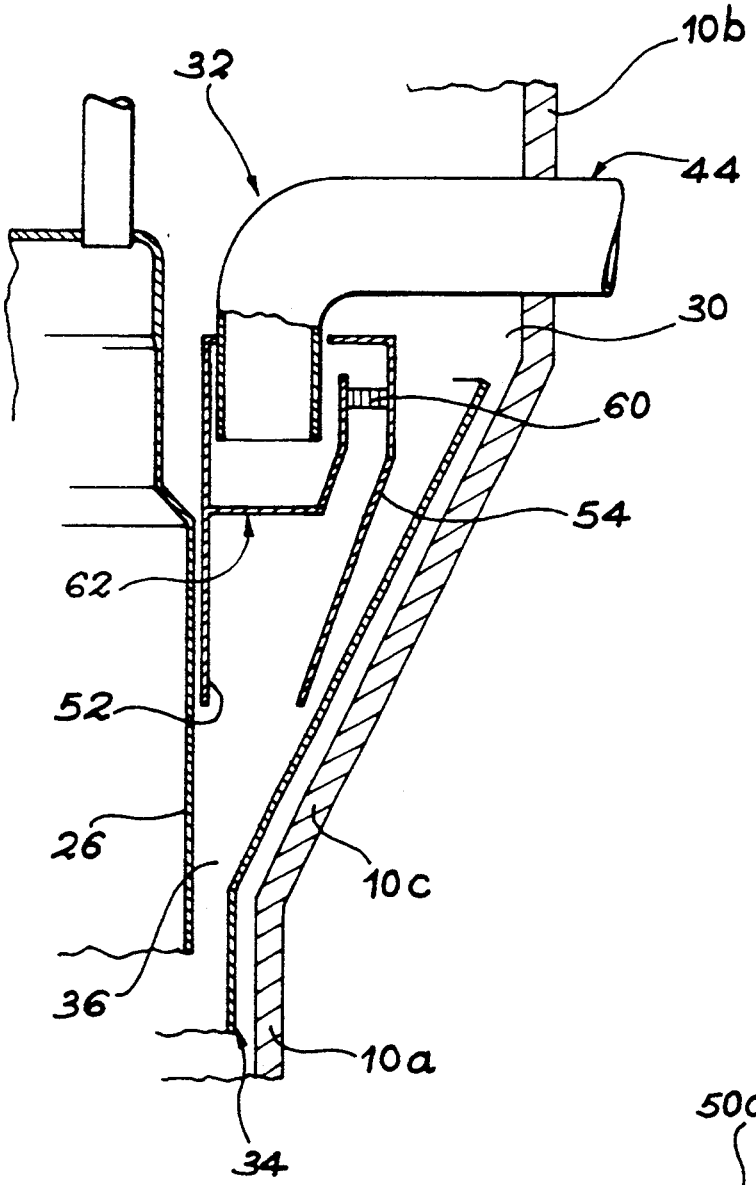
FIG. 6
FIG. 7
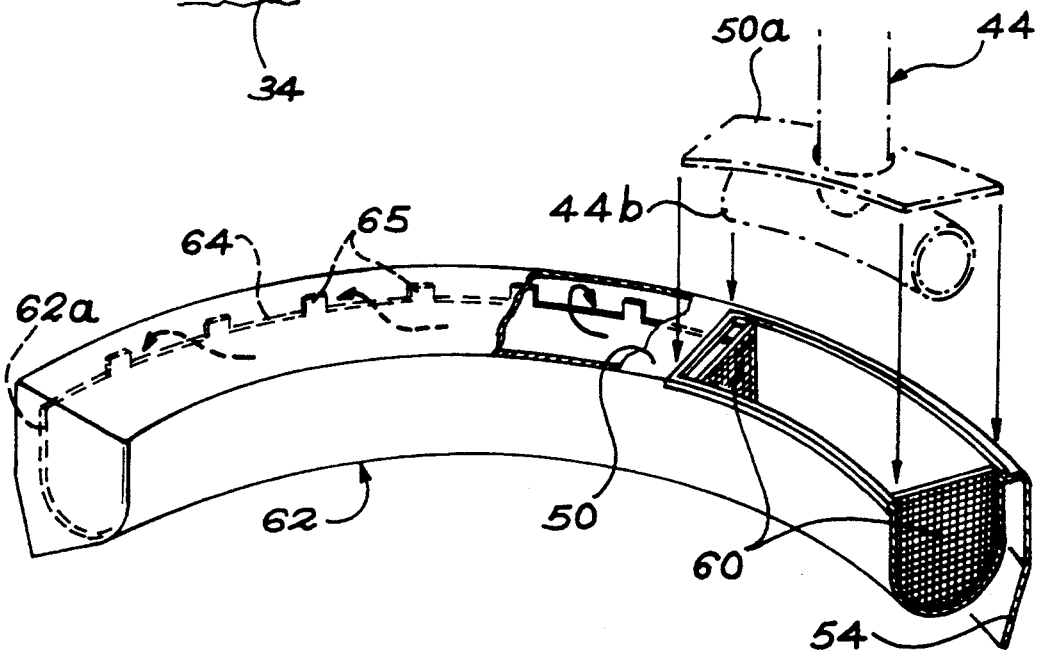

HEAT EXCHANGER, IN WHICH THE SUPPLY OF SECONDARY FLUID TAKES PLACE IN THE UPPER PART BY MEANS OF AN OVERFLOW

FIELD OF THE INVENTION

The invention relates to a heat exchanger such as a steam generator equipping a nuclear power station. It more specifically relates to a heat exchanger having a substantially vertically axed, cylindrical, outer envelope, within which is coaxially arranged a cylindrical bundle or core envelope containing a bundle or nest of heat exchange tubes.

BACKGROUND OF THE INVENTION

In heat exchangers of this type, the primary fluid generally circulates within the tubes of the bundle, whereas the secondary fluid circulates outside the tubes. More specifically, the secondary fluid is injected into the annular space formed between the outer envelope and the bundle envelope, generally into the upper part of the space, so as to drop into the aforementioned annular space and then rise again within the bundle envelope, benefitting from the heat supply provided by the primary fluid circulating in the tubes.

A known solution for injecting secondary fluid into the upper part of the annular space formed between the outer envelope and the bundle envelope is illustrated by FR-A-2 477 265. The secondary fluid penetrates the steam generator by a supply pipe, which is tightly connected to a toroidal or semi-toroidal, sealed supply collector arranged circumferentially in the top of the annular space. On its upper generatrix, the toroidal or semi-toroidal collector has holes to which are connected inverted J-shaped tubes, ensuring the injection of the secondary fluid into the annular space.

This method for injecting the secondary fluid in heat exchangers suffers from a certain number of disadvantages.

Firstly, the special shapes of the injection tubes for the secondary fluid and the upper part of the annular space in which the tubes are housed, as well as the high speed of the secondary fluid jets passing out of these tubes, lead to eddies in the upper part of the annular space. These eddies are prejudicial, because they reduce the thermal efficiency of the heat exchange, particularly when it is a preheating exchanger.

To obviate this disadvantage, FR-A-2 644 926 proposes various solutions, one of which consists of partly sealing the annular space by a non-return plate and downwardly extending the inverted J-shaped tubes by extensions passing through the non-return plate and which are fixed to the latter. However, the structure of the system making it possible to inject the secondary fluid into the heat exchanger then becomes particularly complex and costly.

Moreover, the integration of this structure into the production cycle for the heat exchangers causes problems which are difficult to solve, bearing in mind the manufacturing tolerances which lead to axial misalignments, which are variable for each inverted J-shaped tube, between the lower end of the tubes (not yet provided with their extensions) and the corresponding perforations formed in the non-return plate, in order to permit the passage of the extensions. These problems have the consequence of unduly extending the production cycle for the heat exchangers.

The fixing of the extensions to the non-return plate and to the ends of the inverted J-shaped tubes also leads to a risk of the extensions fracturing under the effect of mechanical stresses produced by differential expansions occurring between operating periods and stoppage periods of the exchanger.

In U.S. Pat. No. 3 913 531 and U.S. Pat. No. 3 906 905, the secondary water supply of a steam generator is also ensured by means of a toroidal collector placed in the top of the annular space formed between the outer envelope and the bundle envelope. On its lower generatrix, the toroidal collector has holes, which issue downwards and directly into the annular space.

Although this arrangement is particularly simple, it also leads to the formation of eddies in the top of the annular space. Moreover, stopping the secondary water supply brings about a complete emptying of the collector, so that water-hammer may occur on resuming the supply.

SUMMARY OF THE INVENTION

The present invention specifically relates to a heat exchanger in which the injection of the secondary fluid takes place into the upper part of the annular space by an injection structure, whose manufacture and integration are simple, rapid and inexpensive and whose operation causes neither eddies, nor a risk of fracturing of mechanical parts under the effect of differential expansions, nor any risk of water-hammer phenomena.

According to the invention, this result is obtained by means of a heat exchanger having an outer envelope and a bundle envelope with a common vertical axis and forming between them an annular space, a bundle of tubes housed within the bundle envelope, secondary fluir supply means located in an upper area of the annular space, and a supply pipe traversing the outer envelope and communicating with the secondary fluid supply means. The characterized in that the said supply means comprise:

an overflow placed in the upper area of the annular space and extending over at least part of the circumference of this the space, overflow having a horizontal upper edge, the supply pipe issuing into the overflow entirely at a level below the level of upper edge, a deflecting wall positioned in front of the edge and extending downwards and obliquely below the edge, so that the secondary fluid admitted into the overflow by the supply pipe and which is discharged over the edge flows downwards into the annular space by trickling along said deflecting wall.

In a heat exchanger produced in this way, the secondary fluid drops from the overflow or weir onto the deflecting wall and then flows along the latter towards the bottom of the annular space. This particularly simple arrangement ensures better circumferential distribution of the flow on the periphery of the annular space and in particular under low flow supply conditions. Moreover, the controlled flow of fluid prevents the formation of eddies, so that the thermal efficiency of the exchanger is maintained. In addition, there is no unwatering or draining of the overflow or supply pipe, which passes into the said overflow. Thus, there is no risk of water-hammer.

In order to prevent fracturing of mechanical parts under the effect of differential expansions and so as to facilitate assembly, the supply pipe is mechanically separated from the supply means formed by the overflow and the deflecting wall.

In a preferred embodiment of the invention, in which the overflow has a horizontal upper wall to which is connected the deflecting wall, the mechanical separation is obtained by the fact that the supply pipe passes with clearance through the upper horizontal wall and has no rigid mechanical link with the overflow.

In this preferred embodiment, the horizontal upper edge is formed on a side wall of the overflow, which is turned towards the outside with respect to the vertical axis common to the outer envelope and to the nest envelope.

One or more migrating body trapping devices are advantageously associated with the secondary liquid supply means. Thus, such a device can be positioned between the outer side wall of the overflow and the deflecting wall.

As a variant, two migrating body trapping devices are placed in the overflow on either side of the supply pipe, the overflow being sealed between the two devices, so that all the secondary fluid admitted by the supply pipe traverses the migrating body trapping devices.

Each migrating body trapping device is in the form of a grid, grating or equivalent structure. As a result, objects such as welding rods, screws, bolts, etc. inadvertently introduced into the secondary circuit of the exchanger during manufacture and penetrating the latter by means of the supply pipe, will not become jammed between the exchanger tubes with the risk of damaging the latter. In practice, the dimensions of the passage holes formed in the migrating body trapping device are at most equal to the minimum spacing between two adjacent tubes of the bundle or nest.

In order to facilitate venting or airing of the overflow, venting or airing perforations can optionally be made on the upper horizontal wall of the overflow.

To avoid adding to the exchanger according to the invention supports enabling the overflow to bear on the bundle envelope or on an intermediate skirt internally duplicating the outer envelope of the exchanger, one of the side walls of the overflow is advantageously formed either by the bundle envelope, or by the intermediate skirt.

BRIEF DESCRIPTION OF THE DRAWINGS

The invention is described in greater detail hereinafter relative to nonlimitative embodiments and with reference to the attached drawings, wherein:

FIG. 3 is a vertical sectional view along line III—III of FIG. 1.

FIG. 6 is a vertical sectional view similar to FIGS. 2, 4 and 5 illustrating a fourth embodiment of the invention.

FIG. 7 is a perspective view illustrating the secondary fluid supply device according to a fifth embodiment of the invention.

DETAILED DESCRIPTION

Figure 1:
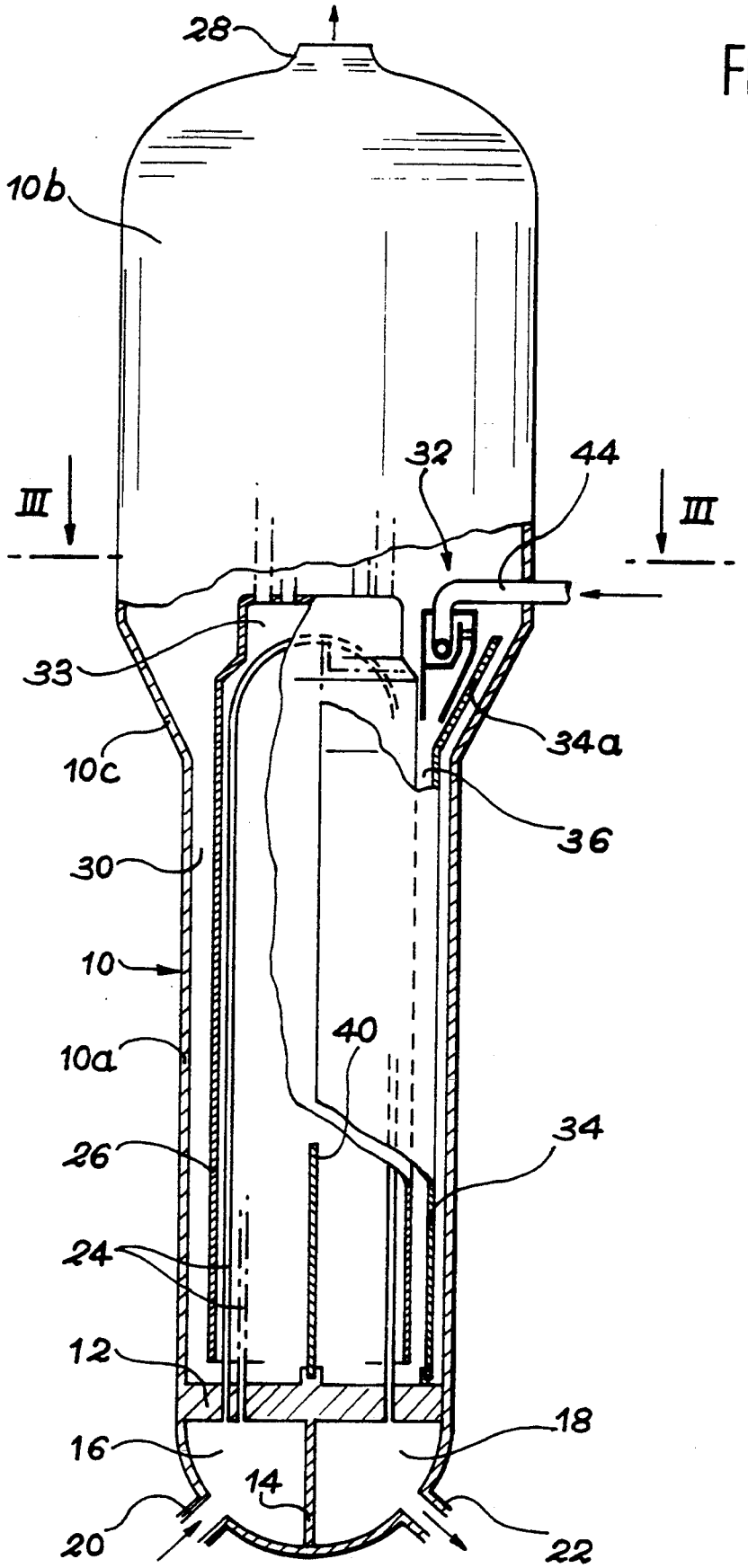
FIG. 1 is a front view illustrating in vertical section a steam generator according to the invention.

FIG. 1 shows a preheating-type steam generator for which the invention is particularly appropriate. However, the invention can also be used in a boiler-type steam generator or in any other heat exchanger having a similar structure.

In FIG. 1, reference numeral 10 designates the vertically axed, outer envelope of revolution of a steam generator for transferring heat between the primary water circuit and the secondary water-steam circuit of a pressurized water nuclear reactor. More specifically, said outer envelope 10 has a relatively small diameter, low part 10*a* and a relatively large diameter, upper part 10*b*, as well as a frustoconical, intermediate part 10*c*. The envelope 10 defines a closed inner space, which is subdivided into a primary lower zone and a secondary upper zone by a horizontal tube plate 12 tightly connected to the envelope 10, at the junction between the lower part 10*a* and the hemispherical bottom of the envelope.

A vertical partition 14 divides the primary lower zone, normally referred to as a water box, into an admission collector 16 and a discharge collector 18 for the water circulating in the primary circuit of the reactor. Tubes 20 and 22, welded to the hemispherical bottom of the outer envelope 10 of the steam generator, respectively connect the collectors 16 and 18 to the primary circuit.

An inverted U-shaped tube bundle 24 is tightly connected to the tube plate 12, in the secondary upper zone defined by the latter. More specifically, the two ends of each of the tubes 24 respectively issue into the admission collector 16 and into the discharge collector 18.

The tube bundle 24 is surrounded and capped by a bundle envelope 26 positioned coaxially within the outer envelope 10. The upper wall of the bundle envelope 26 is positioned substantially level with the junction between the upper part 10*b* and the intermediate part 10*c* of the outer envelope 10. This upper wall is traversed by passages, which communicate with water-steam separators and with drying devices (not shown) located in the upper part 10*b* and which issue at the upper end of the outer envelope 10 by a steam discharge pipe 28. The pipe 28 connects the steam generator to a secondary circuit (not shown).

The bundle envelope 26 defines with the outer envelope 10 an annular space 30. According to the invention, secondary water supply means 32 are placed in the upper part of the annular space 30. A secondary water supply pipe 44 connects the supply means 32 to the aforementioned secondary circuit, traversing the outer envelope 10. Different embodiments of the supply means 32 will be described in greater detail hereinafter.

The lower edge of the bundle envelope 26 is spaced from the tube plate 12 in such a way that the secondary water injected into the top of the annular space 30 by the device 32 drops into the annular space and then rises around the tubes 24, in a space 33 defined within the bundle envelope 26. During said rise, the secondary water is reheated under the effect of the heat exchange which then takes place between the primary water and the secondary water through the walls of the tubes 24. Consequently, the secondary water reaches the upper part of the space 33, as steam. The thus formed steam then traverses the watersteam separators and the drying devices located in the top of the outer envelope 10, before passing out of the steam generator by the pipe 28.

In the case, illustrated in FIG. 1, of a preheating steam generator, a semicircular skirt 34 surrounds the part of the bundle envelope 26 positioned vertically of the discharge collector 18 and in which are placed the downward branches known as cold branches of the tubes 24. More specifically, the skirt 34 is terminated at each of its circumferential ends by two radial partitions 35 (FIG. 3), which are tightly connected to the bundle envelope 36. The skirt 34 extends over most of the height of the bundle envelope 26 and its lower edge is connected to the tube plate 12 by a, semi-tight connection (not shown).

Between the skirt 34 and the bundle envelope 26 is defined a supply space 36, which is open to the top. This supply space 36 communicates at its base with the space 33 defined within the bundle envelope 26 by a passage formed between the lower edge of the bundle envelope and the tube plate 12.

The upper part 34*a* of the skirt 34 has an upwardly flared, frustoconical shape, in order to remain parallel to the frustoconical cone-shaped intermediate part 10*c* of the outer envelope 10.

In a preheating or economizer steam generator, a vertical plate 40 is fixed to the tube plate 12, between the hot and cold branches of the tubes 24, in the lower part of the inner space 33.

The steam generator illustrated in FIG. 1 also comprises a certain number of, horizontal spacing plates (not shown) making it possible, a in conventional manner, to maintain the tubes 24 within the bundle envelope 26.

As is more specifically illustrated by FIGS. 2 and 3, the secondary water supply means 32 according to the invention essentially comprise an overflow or weir 62 and a deflecting wall 54.

In the embodiment shown in FIGS. 2 and 3, the supply pipe 44 radially traverses the upper part 10*b* of the outer envelope 10 of the steam generator immediately above the intermediate part 10*c*. Within the steam generator, the supply pipe 44 has a bend 44*a* oriented 90° downwards, followed by an inverted T 44*b*, whose vertical branch is connected to the bend 44*a* and whose lower horizontal branch issues by its two ends within the overflow 62 in two substantially opposed, horizontal directions. This horizontal lower branch of the inverted T 44*b* has a circular arc axis centered on the vertical axis of the envelopes 10 and 26, as illustrated in FIG. 3.

As is also illustrated in FIG. 3, the supply pipe 44 enters the steam generator at a point located on the side of the cold branches of the tubes 24 and more specifically in accordance with an axis oriented perpendicular to the median plane of the steam generator, separating the hot branches and the cold branches of the tubes 24. The horizontal lower branch of the T 44*b* by which said supply pipe 44 issues into the overflow 62 extends circumferentially on either side of the aforementioned axis over the same circumferential length corresponding to an angle of approximately 30° .

It should be noted that the lower horizontal branch of the T 44*b*, as well as the overflow 62 and the deflecting wall 54 are located in the annular space 32, mainly at a level slightly below that of the upper edge of the skirt 34, which approximately coincides with the junction between the upper part 10*b* and the intermediate truncated cone-shaped part 10*c* of the outer envelope 10.

The overflow 62 constitutes a channel or chute having a U-shaped cross-section. In the embodiment shown, which relates to a preheating steam generator, it extends over the half-circumference of the annular space 30, which corresponds to the supply space 36. The overflow 62 is then sealed at each of its circumferential ends by a vertical wall, which advantageously coincides with the radial partitions 35 (FIG. 3), which at this level define the supply space 36.

In the embodiment illustrated in FIGS. 2 and 3, in which the overflow 62 is totally independent of the bundle envelope 26 and the skirt 34, not shown supports must be provided on one or other of these two structures in order to ensure the fixing of the overflow 62. The overflow 62 has a vertical inner, side wall 52 a horizontal bottom 53 and an outer, side wall 62*a*.

The lower side wall 52 is shaped like a half-cylinder centered on the vertical axis of the exchanger and has a diameter which is constant over its entire height. It is located in the immediate vicinity of the bundle envelope 26 and, in the case illustrated in the drawings, extends from a preheating steam generator over the half-circumference corresponding to the supply space 36.

The inner, side wall 2 is extended downward beyond the overflow bottom 53. It is also extended upward to a level above that of an upper horizontal edge 64 of the outer side wall 62*a*, so as to support an upper horizontal wall 50 of the overflow 62.

This upper horizontal wall 50 is located at a level slightly above that of the upper edge of the skirt 34. In addition, it completely covers the overflow 62 and extends radially outward beyond the outer, side wall 62*a* of the overflow, in order to support the deflecting wall 54. The upper, horizontal edge 64 of the outer, side wall 62*a* is spaced from the wall 64, in such a way as to provide a passage for the secondary water admitted into the overflow 62 by the supply pipe 44.

As is more particularly illustrated in FIG. 2, the upper, horizontal wall 50 has a circular passage 56 traversed by the vertical branch of the T 44*b* of the supply pipe. More specifically this circular passage 56 has a diameter significantly larger than the external diameter of the vertical branch, so as to provide a clearance between these two structures. As there is also no rigid mechanical connection between the supply pipe 44 and the overflow 62, this clearance facilitates assembly and takes into account the differential expansions which occur during the operation of the steam generator. It also allows a limited passage of fluid located during operation within the overflow 62, so as to permit venting of the latter. Perforations 58 (FIG. 3) can also be provided on the upper, horizontal wall 50 of the overflow 62 and also contribute to the venting of the overflow.

The T 44*b* by which the supply pipe 44 issues into the overflow 62 is positioned within the latter, the mouths of the T 44*b* being entirely located at a level below that of the upper, horizontal edge 64. More specifically, the upper generatrix of the lower, horizontal branch of the T 44*b* is located at a level below that of the edge 64.

Taking account of this arrangement, the secondary water admitted into the steam generator by the supply pipe 44 initially fills the overflow 62, before flowing over the edge 64.

The deflecting wall 54 extends downward from the outer, peripheral edge of the upper horizontal wall 50. The deflecting wall 54 has, over most of its height, the shape of a half-truncated cone oriented substantially parallel to the truncated cones formed at this level by the intermediate part 10*c* of the outer envelope 10 and by the upper part 34*a* of the skirt 34. The angle of the half-truncated cone formed by the wall 54 is slightly smaller than that formed by the outer envelope 10 and by the skirt 34, so that the passage provided between the deflecting wall 54 and the upper part 34*a* of the skirt 34 has a cross-section which progressively decreases on passing towards the bottom.

The upper part 54*a* of the deflecting wall 54 is cylindrical and has a uniform diameter over its entire height. The deflecting wall 54 is positioned outside the outer side wall 62*a* of the overflow 62 and at a certain distance from the wall 62*a*. In other words, the deflecting wall 54 faces the upper, horizontal edge 64 of the outer side wall 62*a* of the overflow and extends downwards and obliquely below the latter edge.

As a result of the arrangement which has just been described, the secondary water which flows over the upper horizontal edge 64 drops towards the deflecting wall 54 and then flows downwards along the latter wall and into the supply space 36. In the case of a preheating steam generator of the type illustrated in the drawings, this characteristic makes it possible to inject virtually the entire secondary water flow from the side of the cold branches of the tubes, this ensures optimum efficiency of the steam generator.

This optimum efficiency is also obtained by a particularly simple structure, whose manufacturing costs are reduced compared with the prior art structures. Thus, the secondary water supply device according to the invention can easily be assembled in the factory, so that its integration during the assembly of the steam generator can easily be carried out without any loss of time. During these assembly operations, the upper, horizontal wall 50 of the overflow 62 also forms a floor enabling workers to more easily assemble together the top and bottom parts of the outer envelope 10 before passing out of the steam generator by manholes provided for this purpose. Maintenance of the steam generator is also facilitated by the simplicity of the structure of the secondary water supply device according to the invention.

As is illustrated by FIGS. 2 and 3, a migrating body trapping device can also be integrated into the secondary water supply device according to the invention. This migrating body trapping device is constituted by a grating 60 or any other equivalent device such as a perforated plate. The grating 60 or equivalent device defines passages whose dimensions are at most equal to those separating the closest tubes 24 of the tube bundle. The migrating bodies which may be present in the secondary circuit and whose dimensions might lead to the jamming thereof between the tubes 24 and consequently to the latter becoming damaged, are consequently automatically trapped by the grating 60. In addition, the grating or equivalent device are chosen so as to reduce to the minimum possible extent the passage section for the secondary water.

In the embodiment illustrated in FIGS. 2 and 3, the grating 66 or equivalent device is positioned horizontally in the annular space separating the outer, side wall 62*a* from the deflecting wall 54 and it occupies the entire space. The grating 60 can also be located below the overflow 62, between the walls 52 and 54 and between the radial partitions 35.

In the embodiment of FIGS. 2 and 3, the overflow 62 and the deflecting wall 54 are fixed by means of supports, which are fitted in accordance with the particular case either to the bundle envelope 26, or to the skirt 34. The secondary water supply structure 32 can be further simplified either by directly forming the lower side wall of the overflow 62 on the bundle envelope 26, as illustrated in FIG. 4, or by directly forming the deflecting wall 54 on the skirt 34, as illustrated in FIG. 5.

Figure 4:
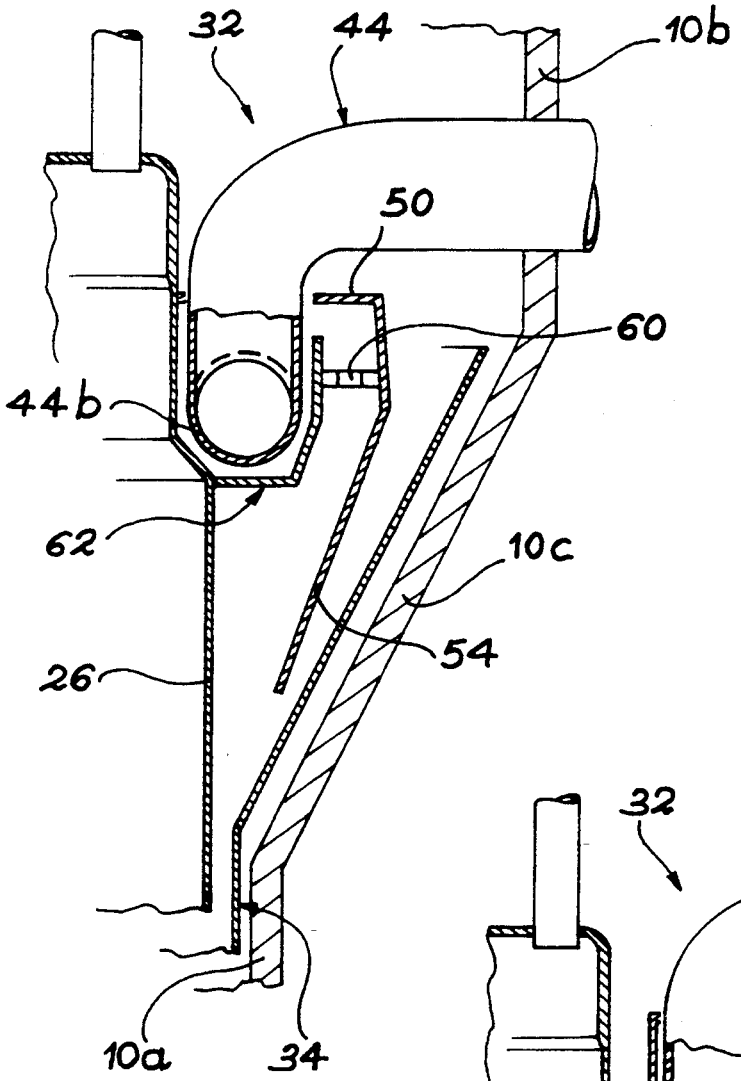
FIG. 4 is a vertical sectional view comparable to FIG. 2 illustrating a second embodiment of the invention.

In the case where the lower side wall of the overflow 62 is formed on the bundle envelope 26, as illustrated in FIG. 4, the upper, horizontal wall 50 is directly fixed to the bundle envelope 26. Moreover, the supply device 32 is completely identical to that described hereinbefore relative to FIGS. 2 and 3. The embodiment of FIG. 4 is the preferred embodiment of the invention, because it combines the structural simplicity due to the elimination of supports for the recovery of recirculation water in the preheating space and the elimination of any unwatering risk with respect to the end of the supply pipe 44 issuing into the overflow 62.

Figure 5:
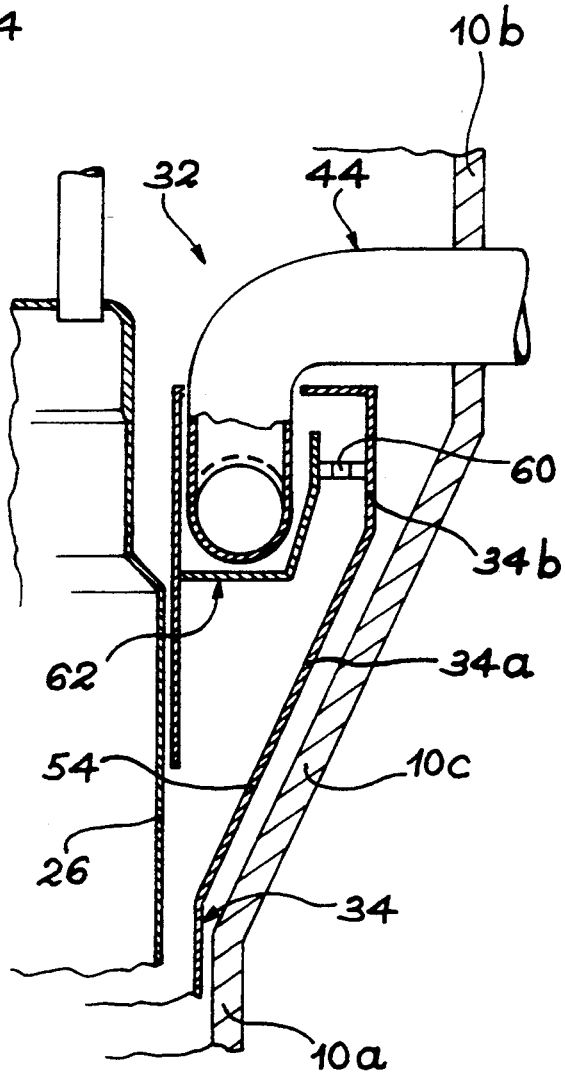
FIG. 5 is a comparable view to similar FIGS. 2 and 4 illustrating a third embodiment of the invention.

In the embodiment illustrated in FIG. 5, the deflecting wall is formed directly on the upper, frustoconical part 34*a* of the skirt 34. This upper part 34 then has an upper cylindrical portion 34*b* and in this case the upper, horizontal wall 50 is directly fixed to the skirt 34.

The embodiments described hereinbefore relative to FIGS. 4 and 5 have the advantage of simplifying the structure of the secondary water supply device, by permitting the elimination of supports connecting the overflow 62 to the bundle envelope 26 or to the skirt 34 in the embodiment of FIGS. 2 and 3. Compared with the embodiment of FIG. 5, the embodiment of FIG. 4 also has the advantage, which also occurs in that of FIGS. 2 and 3, of taking up most of the recirculation water in the supply space 36.

As is illustrated by FIG. 6, the inverted T by which the supply pipe 44 issues into the overflow 62 can, in certain cases, be eliminated. The pipe 44 then issues vertically downwards into the overflow 62. It should be noted that this arrangement can apply to any of the embodiments illustrated in FIGS. 2 to 5.

FIG. 7 shows that the outer, side wall 62*a* of the overflow 62 can be provided, on its upper, horizontal edge 64*a*, with regularly spaced tongues 65, welded by their top end to the upper, horizontal wall 50. These tongues 65 contribute to the mechanical strength of the structure and can be replaced by any equivalent mechanical connection element.

FIG. 7 also shows an installation variant for the migrating body trapping device. In this case, the device comprises two gratings 60 placed directly in the overflow 62 on either side of the end (e.g., in T-shape form 44*b*) of the supply pipe 44. In the area located between the gratings 60, the outer side wall 62*a* of the overflow 62 rises up to the horizontal, upper wall 50, in order to create in the channel a sealed supply region, from which the secondary water can escape only by traversing the gratings 60.

In order to facilitate assembly, a section 50*a* of the upper, horizontal wall 50, sealing the aforementioned supply region, can be separated from the remainder of this wall and instead associated with the supply pipe 44. The functional clearance normally provided between the pipe 44 and the wall 50 is then transferred between the section 50*a* and the remainder of the upper, horizontal wall 50.

The invention can also be used on a boiler-type steam generator having no preheating space or directed supply, or it can also be used on a heat exchanger having a similar structure. In this case, instead of only extending over half the circumference of the annular space 32, the overflow 62 can extend over the entire circumference.

Moreover, the bend 44*a* formed in the supply pipe 44 can be eliminated, the latter then traversing with clearance the deflecting wall 54*a* at the T 44*b* by which the supply pipe issues into the overflow.

What is claimed is:

1. Heat exchanger having an outer envelope and a bundle envelope with a common vertical axis and forming between them an annular space, a bundle of tubes housed within the bundle envelope, secondary fluid supply means located in an upper area of the annular space, and a supply pipe traversing the outer envelope and communicating with the secondary fluid supply means, wherein said supply means comprises:

an overflow placed in said upper area of the annular space and extending over at least part of the circumference of said space, said overflow having a horizontal upper edge, the supply pipe issuing into the overflow entirely at a level below the level of said edge, a deflecting wall positioned in front of said edge and extending downwards and obliquely below said edge, so that the secondary fluid admitted into the overflow by the supply pipe and which is discharged over the edge flows downwards into said annular space along said deflecting wall.

2. Heat exchanger according to claim 1, wherein the overflow has an upper, horizontal wall to which is connected the deflecting wall (54).

3. Heat exchanger according to claim 2, wherein the supply pipe traverses with clearance the upper, horizontal wall and has no rigid mechanical connection to the overflow.

4. Heat exchanger according to claim 2, wherein the upper, horizontal edge is connected to the upper, horizontal wall by regularly spaced, connecting elements.

5. Heat exchanger according to claim 2, wherein the upper horizontal wall has venting perforations.

6. Heat exchanger according to claim 1, wherein the upper horizontal edge is formed on an outer, side wall of the overflow, with respect to the common vertical axis.

7. Heat exchanger according to claim 6, wherein a migrating body trapping device is placed between the outer, side wall of the overflow and the deflecting wall.

8. Heat exchanger according to claim 1, wherein two migrating body trapping devices are placed in the overflow on either side of the supply pipe, the overflow being sealed between said two devices, in such a way that all the secondary fluid admitted by the supply pipe traverses the migrating body trapping devices.

9. Heat exchanger according to claim 1, wherein the overflow extends over only part of the circumference of the annular space, the supply pipe issuing substantially in the center of said part.

10. Heat exchanger according to claim 1, wherein the tubes of the bundle have relatively cold branches and relatively hot branches located on either side of a vertical median plane of the exchanger, the supply pipe issuing on the side of the relatively cold branches.

11. Heat exchanger according to claim 1, wherein the bundle envelope forms an inner side wall of the overflow.

12. Heat exchanger according to claim 1, wherein the deflecting wall is formed by an intermediate skirt internally duplicating the outer envelope over at least part of the height and the periphery of said annular space.

13. Heat exchanger according to claim 1, wherein the supply pipe has a T issuing into the overflow in two substantially horizontal, opposite directions, oriented horizontally with respect to the circumference of the annular space.

* * * * *